US009694890B2

(12) United States Patent
Hartlmeier

(10) Patent No.: US 9,694,890 B2
(45) Date of Patent: Jul. 4, 2017

(54) TOP DOWN FURLING SYSTEM

(71) Applicant: Harken, Incorporated, Pewaukee, WI (US)

(72) Inventor: Greg Hartlmeier, Milwaukee, WI (US)

(73) Assignee: Harken, Incorporated, Pewaukee, WI (US)

( * ) Notice: Subject to any disclaimer, the term of this patent is extended or adjusted under 35 U.S.C. 154(b) by 0 days.

(21) Appl. No.: 14/606,733

(22) Filed: Jan. 27, 2015

(65) Prior Publication Data

US 2015/0210372 A1 Jul. 30, 2015

Related U.S. Application Data

(60) Provisional application No. 61/932,743, filed on Jan. 28, 2014.

(51) Int. Cl.

| | |
|---|---|
| ***B63H 9/10*** | (2006.01) |
| ***D07B 1/06*** | (2006.01) |
| ***D07B 1/16*** | (2006.01) |

(52) U.S. Cl.

CPC ..... *B63H 9/1028* (2013.01); *D07B 1/0673* (2013.01); *D07B 1/162* (2013.01); *D07B 2201/1096* (2013.01); *D07B 2201/2053* (2013.01); *D07B 2201/2055* (2013.01); *D07B 2201/2069* (2013.01); *D07B 2401/202* (2013.01); *D07B 2401/206* (2013.01); *D07B 2401/2015* (2013.01); *Y10T 428/2929* (2015.01)

(58) Field of Classification Search

CPC ... B63H 9/00; B63H 9/04; B63H 9/08; B63H 9/10; B63H 9/1028; B63H 9/06; D01F 8/10; D01F 8/12

USPC ..... 114/104, 105, 106, 108; 464/56, 57

See application file for complete search history.

(56) References Cited

U.S. PATENT DOCUMENTS

| | | | |
|---|---|---|---|
| 5,463,970 | A | 11/1995 | Hartlmeier |
| 6,082,282 | A | 7/2000 | Kickert |
| 6,318,285 | B1 | 11/2001 | Hartlmeier |
| 6,591,771 | B2 | 7/2003 | Greghi |
| 7,263,941 | B2 | 9/2007 | Greghi |

(Continued)

FOREIGN PATENT DOCUMENTS

| | | |
|---|---|---|
| EP | 0878391 | 11/1998 |

OTHER PUBLICATIONS

Sailing Rope | Novabraid. Novatec Braids Ltd. Oct. 19, 2013 [reVieved on Apr. 2, 2015] 4,6,7 Retrieved from the Internet: <URL: http://www.novabraid.com/rope/application/performancesailing.html>.

(Continued)

*Primary Examiner* — Lars A Olson

(74) *Attorney, Agent, or Firm* — Brian G. Gilpin; Godfrey & Kahn, S.C.

(57) ABSTRACT

An improved top down furling system includes one or more improved components. A lower rotary drive unit with a rotary tack swivel rotates against a fixed portion of the furler, or is configured to permit routing of the tack line below the unit. The system may include an anti-torsion cable constructed in a manner so as to be able to transmit torque without excessive tension applied to the cable. The system also may include an end terminal of the anti-torsion cable having a quick side mount or bayonet type connection to the rotary drive unit.

2 Claims, 8 Drawing Sheets

(56) References Cited

U.S. PATENT DOCUMENTS

| | | | | |
|---|---|---|---|---|
| 7,975,635 | B2 | 7/2011 | Greghi | |
| 8,944,924 | B2 * | 2/2015 | Funke, Jr. ..... | F16C 1/02 114/106 |

OTHER PUBLICATIONS

Gennex Endless Classic Series A2-112-x. Manual [online]. Bartels GmbH. 2012. [retrieved on 8-9 Apr. 1, 2015]. Retrieved from the Internet: <URL: http://www.Bartels.eu/fileadmin/bartelsJtemplates/downloads_Nautik/CodeO_GEN NEX/E_Katalog_GEN NEX_CODEO_8-9.pdf>.

International Search Report for PCT/US2015/013128; mailed May 8, 2015.

* cited by examiner

TOP DOWN FURLING SYSTEM

CROSS REFERENCE TO RELATED APPLICATION

This application claims priority from U.S. Provisional Patent Application Ser. No. 61/932,743, filed Jan. 28, 2014, the disclosure of which is hereby incorporated by reference herein in its entirety for all purposes.

FIELD OF THE INVENTION

The present invention relates generally to the field of sailing. More particularly, the present invention relates to an improved system and components for furling asymmetrical spinnakers and similar types of sails. The improved system and components make furling sail systems easier to use, lighter weight and less expensive.

BACKGROUND

On racing and cruising sailboats, devices for furling asymmetrical spinnakers, gennakers, all-purpose sails ("APS") or similar type sails, have widely been used to furl sails prior to lowering, and similarly to hoist furled sails and unfurl for use. Examples of aspects of certain prior art furling-related devices are shown in U.S. Pat. Nos. 7,263,941 and 6,591,771 to Greghi and 6,318,285 and 5,463,970 to Hartlmeier et al. As shown in FIG. 1, a depiction of the primary components of a typical currently available furling system, these furling systems consist of a lower rotary drive unit 3A located near the bow connected to an anti-torsion cable 5A capable of transmitting a torque load to an halyard swivel 29A located near the top of the mast. The rotation of the lower rotary drive unit 3A is transmitted through the length of the anti-torsion cable 5A to rotate the lower portion of the halyard swivel 29A. The head 20 of a sail 27 attaches to the end terminal 69A at the top of the anti-torsion cable 5A or to the lower part of the halyard swivel 29A. The tack of the sail has a tack line 20 that is connected to the lower rotary drive unit 3A at a separate rotary tack swivel 21A so it does not rotate with the system until the very end of the furling operation. The sheets secured to the clew 22 are the third attachment to the sail; no others. The rotation force of the lower rotary drive unit 3A acts only on the top of the sail causing the head of the sail to furl first, so the sail progressively furls around the anti-torsion cable 5A. For this reason, this system is commonly known as a "top down furler." Techniques have been developed by sailors to neatly furl the sail so it can be lowered to re-hoist and easily unfurled at a later time.

The lower rotary drive unit 3A is driven by a furling line 23, either wound on a spool or more often a sheave drive where the continuous looped furling line 23 wraps around the drive sheave. Textured features on the drive sheave, as well as a "V" shape of the sheave so the line pushes into the "V" as loads increase, grip the line to turn the lower drive unit when the furling line is pulled. The lower drive unit is also sometimes powered using a hydraulic or electric motor. The lower rotary unit and halyard swivel 29A are rotatably mounted in a bearing system to help reduce rotational friction from the fixed portions connected to bow 25 and halyard at masthead 26.

The lower rotary unit rotary tack swivel 21A provides a connection to the tack of the sail 27 that does not rotate with the drum or sheave drive in the lower rotary drive unit 3A. This allows the top of the sail to furl first because the tack can lag behind and remain stationary with the bow of the boat. In some cases this separate rotary tack swivel 21A is fastened directly to the lower rotary drive unit 3A. In other cases the rotary tack swivel 21A is tethered to the lower rotary drive unit 3 and rides on a shaft so its height can be adjusted. In either case ball bearings and races are used to reduce friction between the rotary tack swivel and the main rotary section with its pinned connection to the anti-torsion cable. Also, because the rotary tack swivel 21A is secured to the rotating portion of the lower rotary drive unit 3A, the loads on the sail tack are transferred to the main bearing system in the lower rotary drive unit 3A.

The anti-torsion cable 5A attaches to the top of the lower rotary drive unit 3A. When the lower rotary drive unit is rotated, the anti-torsion cable 5A rotates the halyard swivel. It is important that the halyard swivel 29A and the lower rotary drive unit turn at close to a 1:1 ratio. The anti-torsion cable 5A must be able to resist torsion and also be flexible enough to be coiled for storage after the furled sail is lowered. The longer the length of the anti-torsion cable, the more it has a tendency to twist, so that more rotations are required at the lower end of the anti-torsion cable compared to the upper end. Conventional anti-torsion cables 5A consist of braided low stretch fibrous materials such as Kevlar®, Dyneema® or Poly (p-phenylene-2,6-benzobisoxazole) ("PBO"), a rigid-rod isotropic crystal polymer. PBO fiber is a high performance fiber that has superior tensile strength and modulus compared to aramid fibers, such as Kevlar®, Technora® and Twaron®. Such materials are expensive to produce and sometimes layered with plastic strips to help increase resistance to torsion. Because the sail furls on the anti-torsion cable 5A, each separate asymmetrical spinnaker, gennaker and APS must have its own anti-torsion cable 5A.

The construction of the anti-torsion cable 5A consists of fibers woven and braided in two opposite helical or spiral directions around the length of the anti-torsion cable 5A. The materials used in the anti-torsion cable 5A have strength in tension but not in compression. Also the fibers used for reinforcement have negligible stiffness as an individual thread. When the anti-torsion cable 5A is not in tension, the individual fiber threads have space to move and constrict when torsion is applied, so there is twist. Anti-torsion stiffness is gained by tensioning the fibers in the weave so they become more densely compacted and there is nowhere for them to move. Tension increases the density of the weave thereby increasing the ability to transmit torque without twist. As a result, the anti-torsion cable 5A must be under very high tension before furling to increase the anti-torsion capability, so the cable will transmit the torque without twist or torsion.

To provide enough tension, sometimes halyards are led through a 2:1 block and tackle and or a large winch is used to achieve the tension required to transmit the torque at a 1:1 ratio between lower rotary drive unit 3A and the halyard swivel 29A. This high tension requires that hardware, such as bow sprits, their connections and halyard sheaves near mastheads, have higher strength capacity than hardware built for normal sail loading. The added weight to handle higher loads near the bow and masthead detracts from the sailboats overall performance and designers are always striving to make these areas lighter. This tension is very often applied before furling and not while using the asymmetrical spinnaker, so it requires a dedicated step. In many cases, before furling, the existing anti-torsion cables must be pre-twisted in order to furl because they do not have the anti-torsion capability, this thus requiring another dedicated step.

The ends of the anti-torsion cable 5A must be securely joined to an aluminum end terminal 9A due to the very high loads required for transmitting the torque using the anti-torsion cable 5A. Various fusing and bolting methods are used to secure the anti-torsion cable to the end terminal 9A. The connection of the end terminal 9A to the lower rotary drive unit 3A and the halyard swivel 29A consists of a fork and tang with a pin connection with locking mechanism, or other means, including two cylindrical metal parts pinned or bolted together to transmit the torque. They must be able to withstand high tension loads and torsion loads due to the requirement to have high loads to increase the torque capability of the anti-torsion cable.

Furthermore, due to the requirements to highly tension the anti-torsion cable 5A, bearings in the lower rotary drive unit 3A and halyard swivel 29A must be capable of handling higher loads than are required for sailing. As such, the lower rotary drive unit and halyard swivels require large diameter bearings and supporting races which add weight to the lower rotary drive unit 3A and the halyard swivel 29A. As an alternative, hardened steel bearings are sometimes used, requiring seals which add more friction to the rotational furling. In either case, the greater the tension, the more rotational friction is produced. Friction in the halyard swivel requires an anti-torsion cable with added torque transmitting capability to overcome this friction.

As such, there is a need for an improved system and components for a top down furling system. The improved system can include some or all of the following features and components:

- a lower rotary drive unit that can easily drive the anti-torsion cable and handle the need to let the tack line lag behind the rotation of the anti-torsion cable without transferring the tack line loads to the bearings in the lower rotary drive unit;
- a lower rotary drive unit with fewer moving parts thereby providing lower weight on the bow of the boat and lower manufacturing cost;
- an anti-torsion cable that can transmit torque without being under high tension thereby reducing the required strength of all connecting components and bearing systems, hence reducing the weight and the expense of manufacturing the cable and all related furling parts of the system, and also simplifying the number of steps required to furl;
- a quicker way to connect and disconnect the anti-torsion cable to the lower rotary drive unit and the halyard swivel so sails can be quickly connected to the lower rotary drive unit and the halyard swivel; and/or
- a halyard swivel design that takes advantage of the lower load requirements of the anti-torsion cable and provides a way to easily attach the head of the sail without using heavy shackles.

SUMMARY

Disclosed is an improved top down furling system includes one or more improved components. A lower rotary drive unit with a rotary tack swivel rotates against a fixed portion of the furler, or is configured to permit routing of the tack line below the unit. The system also includes an anti-torsion cable constructed in a manner so as to be able to transmit torque without excessive tension applied to the cable. The system also includes an end terminal of the anti-torsion cable having a quick side mount or bayonet type connection to the rotary drive unit.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiments, and will be readily apparent to those skilled in the art. Such objects, features, benefits and advantages will be apparent from the above as taken in conjunction with the accompanying Figures and all reasonable inferences to be drawn therefrom.

DETAILED DESCRIPTION

The top down furling system of this invention overcomes the shortcomings of existing systems in two primary aspects (although they can be used together or independently of one another). In the first, an anti-torsion cable 5 uses construction materials and techniques to be able to transmit torque without excessive tension applied to the cable. In the second aspect, an end terminal 9 has a quick connection so the furled sail can be easily disconnected for stowage or to connect another sail.

The two improved aspects of the top down furling system work together to improve the ease of furling, reduce the overall weight of the system, and reduce the expense of manufacturing the components. By removing the requirement to over-tension the anti-torsion cable, the system can be much lighter duty and the bearings in the lower rotary drive unit and halyard swivel can be simplified and can run more freely. Because loads are less, lighter duty bearings can be used, which are more easily rotated than high load bearings. As an example, balls could be used which roll more easily than rollers and sealed bearings. Because the loads are less, the anti-torsion cable requires less torsion resistance of the anti-torsion cable to drive the halyard swivel. The tack, connected to a rotary tack swivel 21 in which the loads are separated from the primary bearing system 28 of rotary drive unit, provides further load reduction, with all its benefits of lower weight and less cost. Furthermore because the anti-torsion cable does not require excessive tension, the bonding of the cable to the end terminal can be manufactured to a lower strength, because it does not have to withstand such high load. Finally the side load or bayonet style attachment of the terminal on the anti-torsion cable gives a quick connection to the lower rotary drive unit, helping with sail take down, as well as quick sail changes. Because of the lighter tension loads on the system, the anti-torsion cable attachment components can also be manufactured to a lower strength and thereby be lighter. The halyard swivel design can take advantage of lower load requirements and provide a lower weight aloft. Illustrative embodiments of each of the foregoing aspects are described herein.

Figure 1:
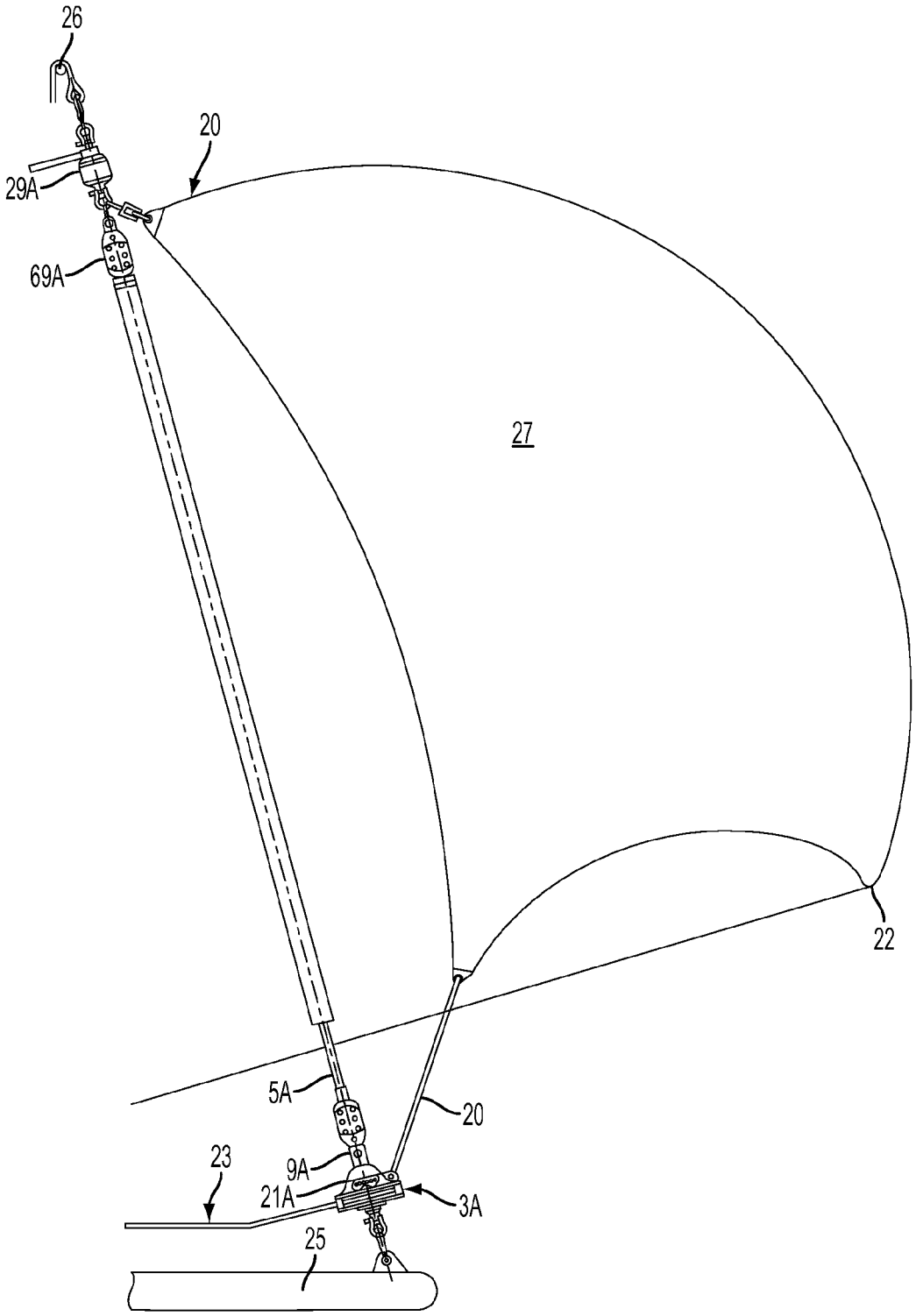
FIG. 1 PRIOR ART
FIG. 1 is a side schematic view of a prior art top down furling system.

As shown in FIG. 1, where conventional parts are labeled with an "A" suffix, and similar parts in this disclosure use the same numbering, but without the "A," the main components of a top down furling system are the lower rotary drive unit 3, end terminals 9 and 69 at each end of an anti-torsion cable 5, and a halyard swivel 29 at the top for connection to the masthead 26.

Figure 2:
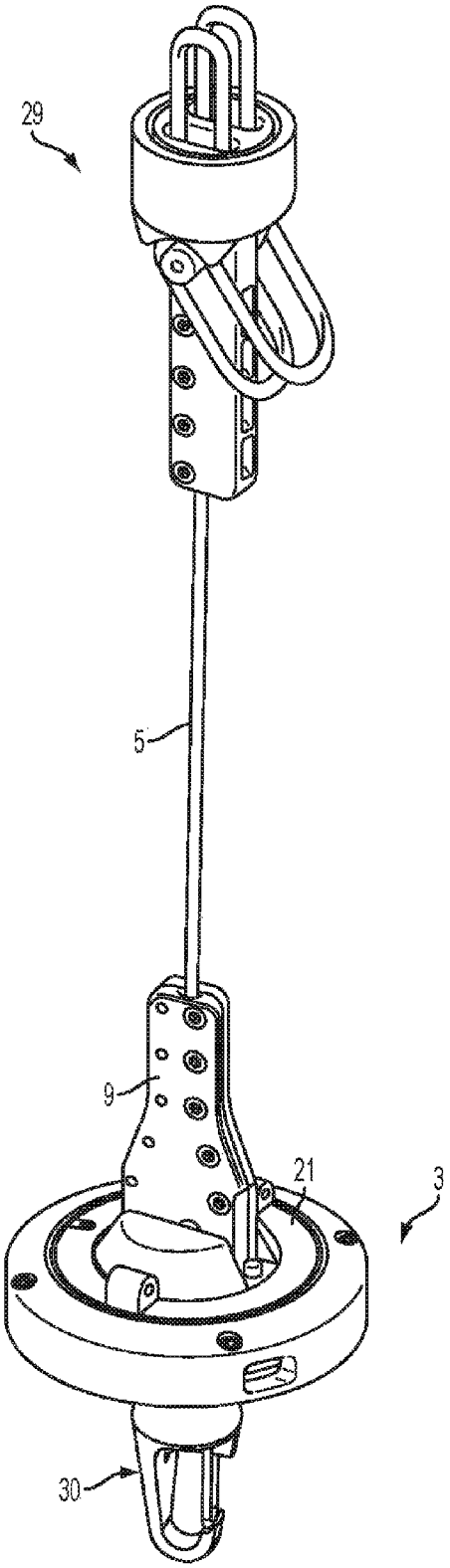
FIG. 2 is a side perspective view of a top down furling system according to this disclosure.
Figure 2A:
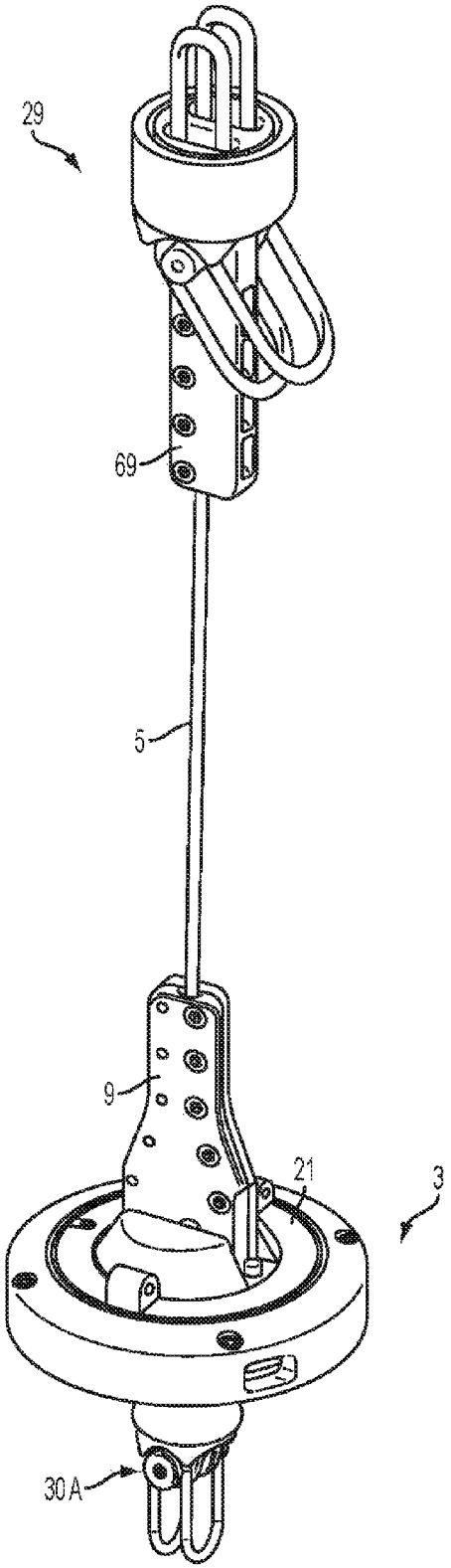
FIG. 2A is a side perspective view similar to FIG. 2 accept for using an alternate method of attaching a lower drive unit to the bow of a boat.
Figure 8:
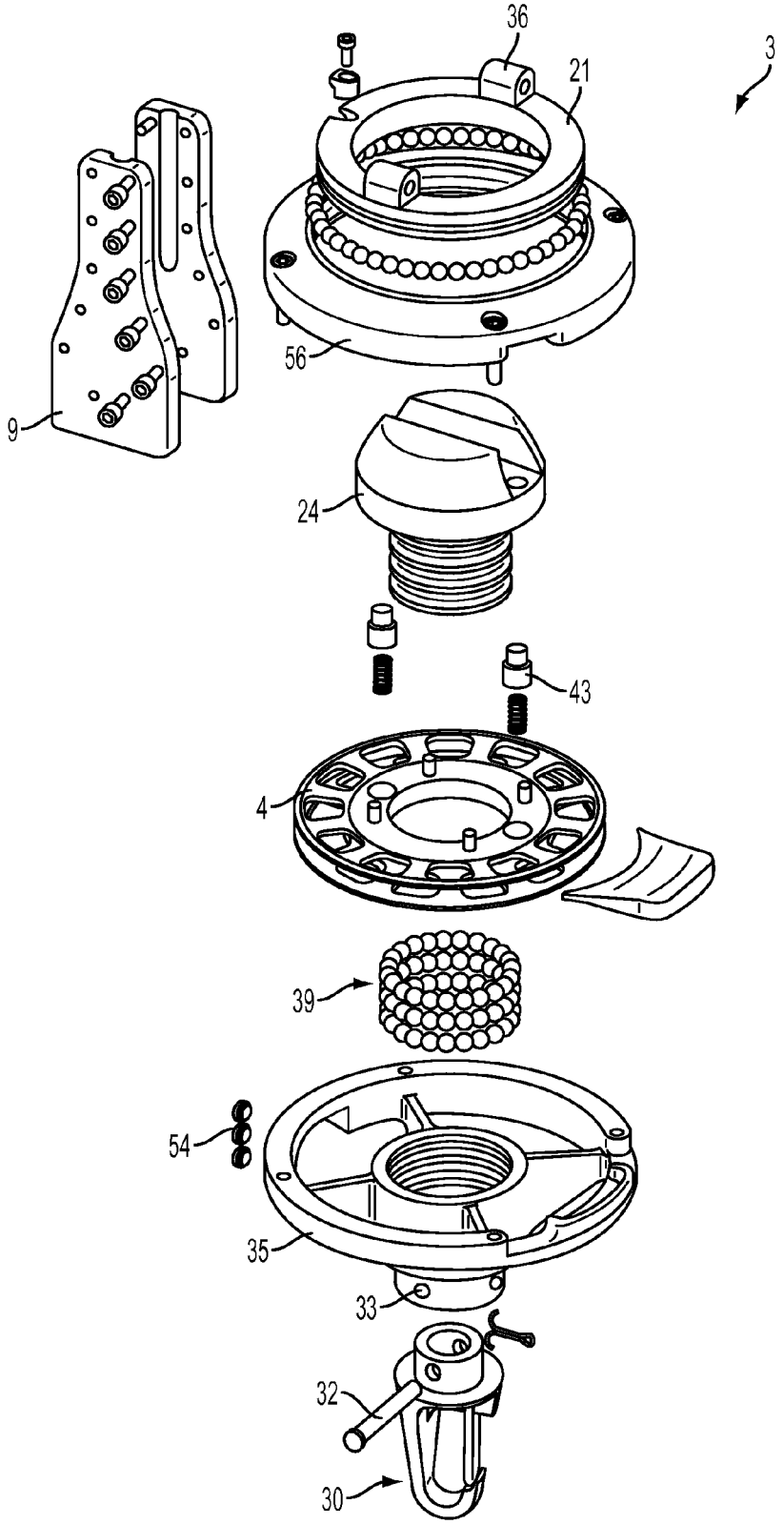
FIG. 8 is a side exploded perspective view of the cable terminal and the lower rotary unit of the top down furling system of FIG. 2.
Figure 8A:
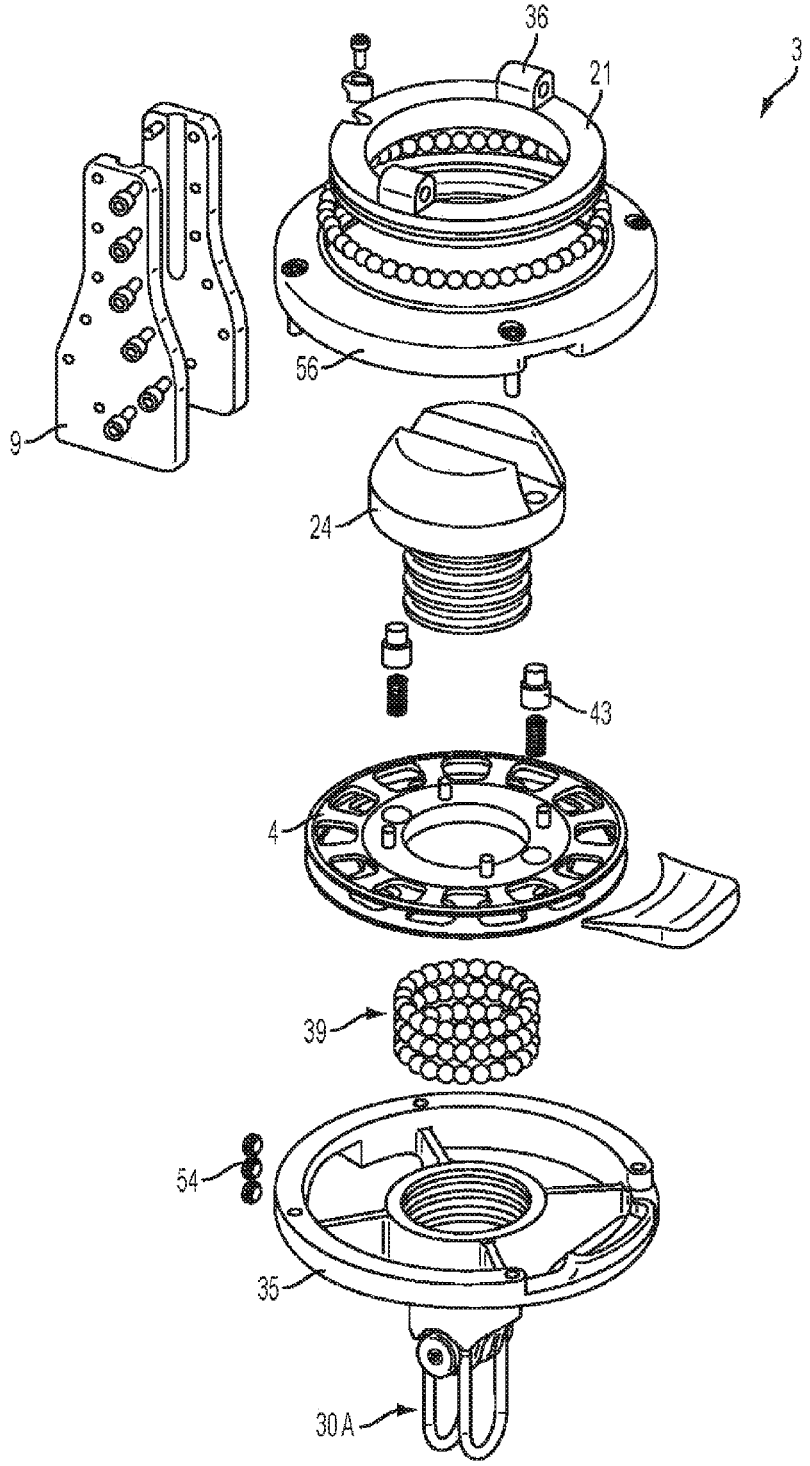
FIG. 8A is a side exploded perspective view of the cable terminal and the lower rotary unit of the top down furling system of FIG. 2A.

FIG. 2 shows the lower rotary drive unit 3 with removable hook attachment 30 which uses a wire gate 31 with biased attachment to provide a spring shut action. A clevis pin 32 inserts into one of two sets of hook mounting holes 33 so the hook 30 can be positioned in line or 90 degrees to the furling line entry points 34 shown clearly in FIG. 6. As shown in FIG. 8, the rotary tack swivel 21 is rotatably connected to the fixed drum portion 35 of the lower rotary drive unit 3. The fixed portion 35 stays fixed to the bow of the boat using some securing method such as the hook attachment 30, or a shackle or lashing (not shown). As shown in FIG. 2A and FIG. 8A, another means of fixing the lower rotary drive unit 3 to the bow 25 can include a bow loop attachment 30A secured around a cross pin mounted in the fixed portion 35.

In this embodiment, the fixed portion is the outer race. In other embodiments (not shown), the fixed portion could also be the inner race or driven hub 24. In other embodiments, the fixed portion 35 may have components that are bolted or glued together. The rotary tack swivel could be a separate bolt-on piece fastened to the fixed portion. Bearings or a low friction bearing material are used to reduce the rotational force required for rotation. The rotary tack swivel balls 57 provide a low friction rotation of the rotary tack swivel 21 in relation to the top 56 of fixed portion 35. The spinnaker tack line 20 secures to the rotary tack swivel at one of the lashing eyes 36. Alternatively, the tack line 20 can secure to a pulley secured to the lashing eye 36 so the tack line length can be adjusted for sail trim. When the lower rotary drive unit is rotated using the furling line 23, the rotary tack swivel 21 can lag behind the furling sail because it is not connected to the driven hub 24 of the lower rotary drive unit. Once the sail is furled either completely or at least a large part, the tack of the sail 27 will often need to begin rotating to complete furling. Different sail shapes may not require this further rotation. The tack swivel bearing system 39 provides low rotating friction to let the tack line 20 continue to furl with the sail until completely furled. Because the rotary tack swivel 21 is not bearing on the driven hub 24 of the lower rotary drive unit 3, there is less load on the rotary tack swivel main bearing system 39. To mount the balls in the tack swivel bearing system 39, a ball loader plug 40 screws to the body of the rotary tack swivel 21.

Anti-Torsion Cable Using a Layer of High Tensile Filaments.

Figure 3:
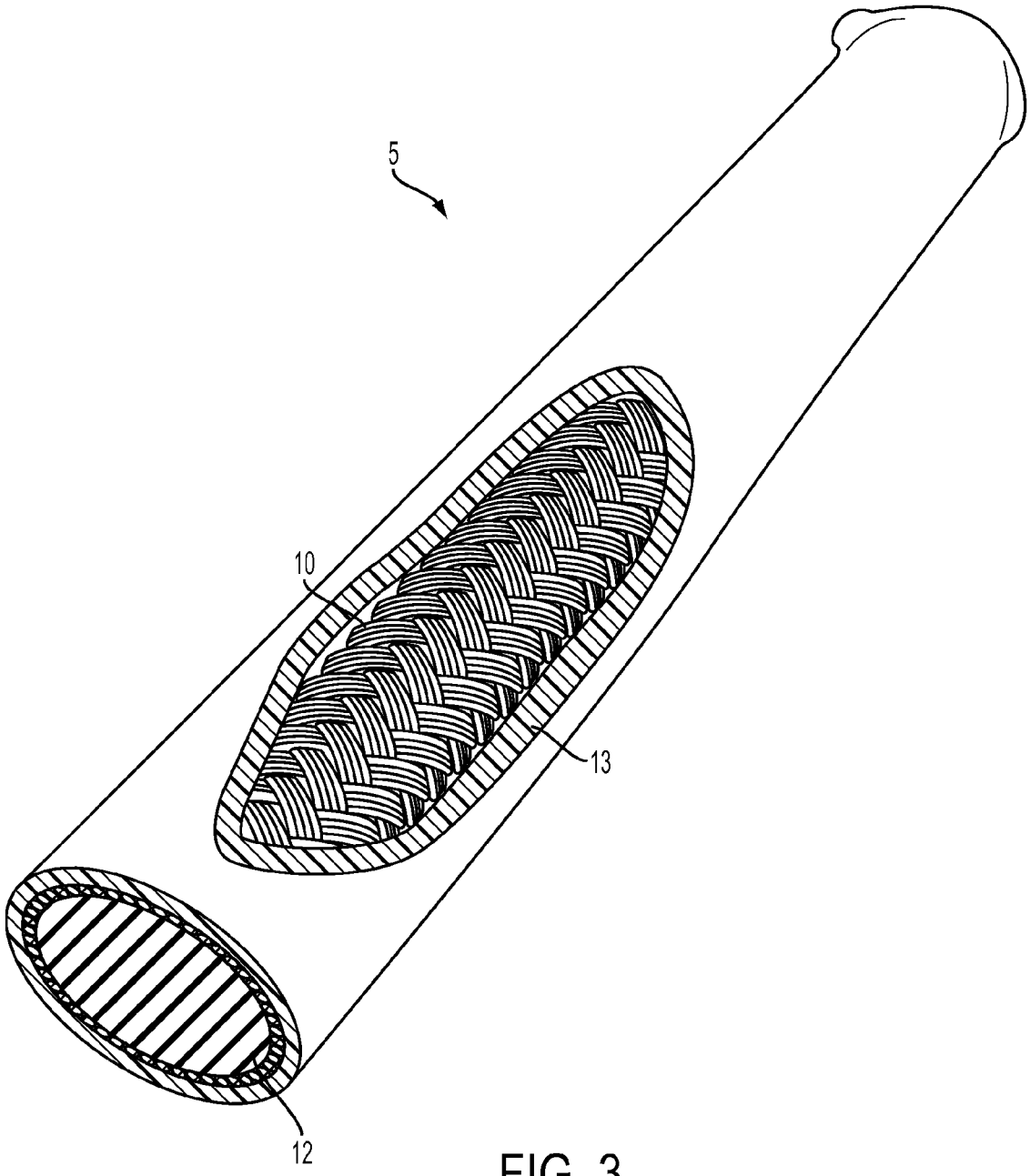
FIG. 3 is a perspective view of a cut section of an improved cable of the top down furling system of FIG. 2.

FIG. 3 shows a portion of the anti-torsion cable 5 attached to the end terminal 9 which connects to the lower rotary drive unit 3 and extending upwards to an end terminal attaching to the halyard swivel unit.

The anti-torsion cable 5 uses a reinforcing layer of a braided or interwoven material that does not require excessive tension to transmit torque up the cable to the halyard swivel unit 29. In this embodiment, steel wire filaments are used in the cable construction. Each wire filament is stiff independently of the weave resulting in a reinforcement that provides torsional stiffness to the finished woven cable both in compression and in tension so the excessive tension is not required to resist torsion while furling. During construction, the wire mesh can be heated so it can adhere to inner and outer layers to provide further torsional stiffness, yet still allow the cable to be coiled for storage. The cost of steel as a reinforcement is much less compared to material such as PBO, Kevlar®, Technora® or Twaron®.

This cost is multiplied by each anti-torsion cable used for each sail in a racer's inventory. Because less tension is required on the anti-torsion cable, the size and strength all other connecting components can be less. This includes lower rotary drive unit 3, halyard swivel 29, masthead connections and bow or bowsprit connections. There would also be no need for 2:1 halyard systems to achieve high tension before furling. Less tension requirements also means that the bearings in the lower rotary drive unit 3 and the halyard swivel 29 can be lighter duty. Balls can often be used instead of high load carbon steel sealed bearings thereby providing a freer running system, more easily driven by the anti-torsion cable 5.

Thus, the anti-torsion cable 5 is of composite construction and has an inner reinforcing braided layer of high tensile filaments which are also stiff in compression, extending helically in both directions to substantially increase the torsion resistance of the anti-torsion cable 5 without applying tension to the cable. The cable is flexible enough to allow the cable to be coiled along its length for storage.

More particularly, the cable 5 includes a reinforcing braided layer 10 preferably comprising a plurality of reinforcing wires, bands or filaments extending in one or in two opposite helical or spiral directions around the length of the anti-torsion cable. These filaments, in compression and tension, oppose torsional forces exerted on the anti-torsion cable as a result of furling operations.

Stainless steel has been found to be an effective material to manufacture the wires but other materials of suitable strength and stiffness could be used. By using steel wires or filaments which are stiff in compression and torsion, the number of filaments working to provide torsional stiffness doubles.

The actual stiffness of individual and isolated steel wires before they are interwoven is greater than individual and isolated threads of textile fibers such as Kevlar further providing increased torsion resistance without tensioning the cable.

In the illustrated embodiment, the core 12 is made of rubber. Rubber provides the flexibility needed by the cable, while at the same time aiding in its torsional capabilities. It has also been found effective to manufacture the core 12 from other materials, such as conventional braided nylon rope. The function of the core 12 is to be a flexible support for the reinforcing braided layer 10 so that the reinforcing braided layer 10 does not collapse upon itself when placed under significant torsional force. Thus, any material of suitable flexibility and compressive characteristics could be used. Indeed, core 12 could be provided and installed entirely separately from the rest of the components.

The cable 5 as shown also includes a cover 13. While the cover 13 may be made separately and bonded to the braided layer 10 by adhesive, it is preferable to extrude the cover 13 directly over the braided layer 10 by a co-extrusion process, using a die of suitable configuration, through which the inner portion and molten thermoplastic are coextruded. The cover 13 is preferably composed of a relatively hard and somewhat flexible thermoplastic material having good resistance to the sun and oxidation, such as polyvinyl chloride. The primary function of the cover is to protect the braided layer from saltwater spray and prevent corrosion. Thus, any suitable materials or covering techniques could be used, e.g., wrapping. Even a cable 5 without a cover could function effectively although it would not likely have the desired durability depending on the environmental conditions.

The use of a helical or spiral reinforcing layer has the advantage that the layer is very flexible lengthwise but provides substantial torque resistance. The pitch of the reinforcing layer may be decreased for added torsional resistance, or increased where less resistance is needed. As a specific example, for a foil having an approximate length of 31 feet, a stainless steel braid may be employed in which the braid comprises twenty-four bundles of wire, with eight wires in each bundle, and being braided at a 1.56 inch pitch. This results in a foil having less than one revolution of twist in maximum wind conditions.

Quick Attachment and Release System of End Terminals.

FIGS. 4-7 shows the location of a quick attachment and release system of the end terminal 9 for the anti-torsion cable to the lower rotary drive unit 3. A similar quick attachment and release system (not shown) can also be used to join the end terminal 69 to the halyard swivel 29. In this context, the lower rotary drive unit and the halyard swivel are both referred to as a terminal receiving device.

FIGS. 4-7 also show a quickly operated connect/disconnect of the end terminal of the anti-torsion cable 5 from the lower rotary drive unit 3. This design permits the user to quickly disconnect the sail and anti-torsion cable 5 leaving the lower rotary drive unit 3 and halyard swivel 29 in place on the bow of the boat after lowering so that the same sail or another sail can be quickly loaded/unloaded much easier than with the pin and locking mechanisms currently used. Also, if the furled sail and lower rotary drive unit 3 and halyard swivel 29 are lowered and removed from the bow, the design allows a much easier and faster method of switching sail and anti-torsion cable than using pins and locking mechanisms currently used.

As shown in FIGS. 4-7, the top portion of the driven hub 24 forms a receptacle 38 to connect the end terminal 9. The end terminal 9 has lips 19 that fit into undercuts 41 in the receptacle 38. These features could be machined into the end terminal or receptacle or components added to create a similar connection. The fit of lips 19 into undercuts provide tensional strength as the load is applied to the anti-torsion cable 5 while using the system. Additionally the receptacle length 42 and corresponding terminal provide leverage to drive the anti-torsion cable without over stressing the receptacle and terminal fit. This provides a better torque transmission as compared to the typical eye to fork joining by other furlers. Other means of creating lips or protrusions to fit in the undercuts on the receptacle could be used to accomplish the same quick attachment. To lock the end terminal 9 into the receptacle 38, a spring loaded button 43 is used at the entrance. If there are two entrances, a spring loaded button 38 is used at each end.

The spring loaded button 43 is formed from a short cylinder with one end closed and rounded, the other end open. The open end also includes a flange for keeping the button within the opening in the driven hub 24 through which it passes. A spring is positioned within the cylinder, engaging the closed end of the cylinder and the drive sheave 4 beneath the cylinder so that the cylinder is biased by the spring so that the button is held in a position where the button extends above the surface adjacent the end of the terminal 9, as shown in FIGS. 6 and 7.

Figure 5:
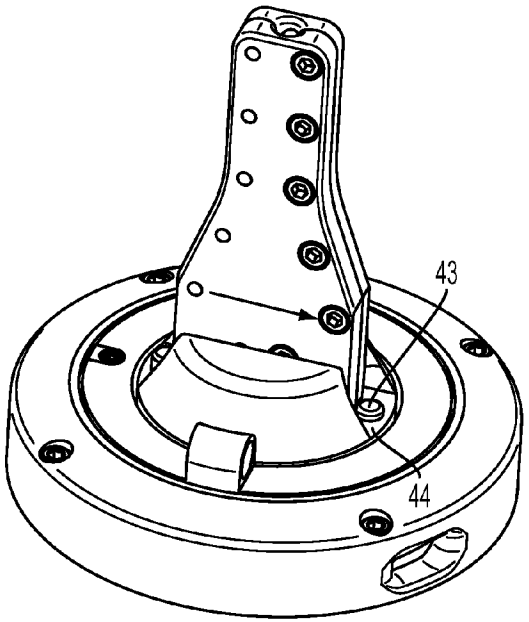
FIG. 5 is a view similar to FIG. 4, with an arrow showing how the cable terminal can be removed from the lower rotary unit.
Figure 4:
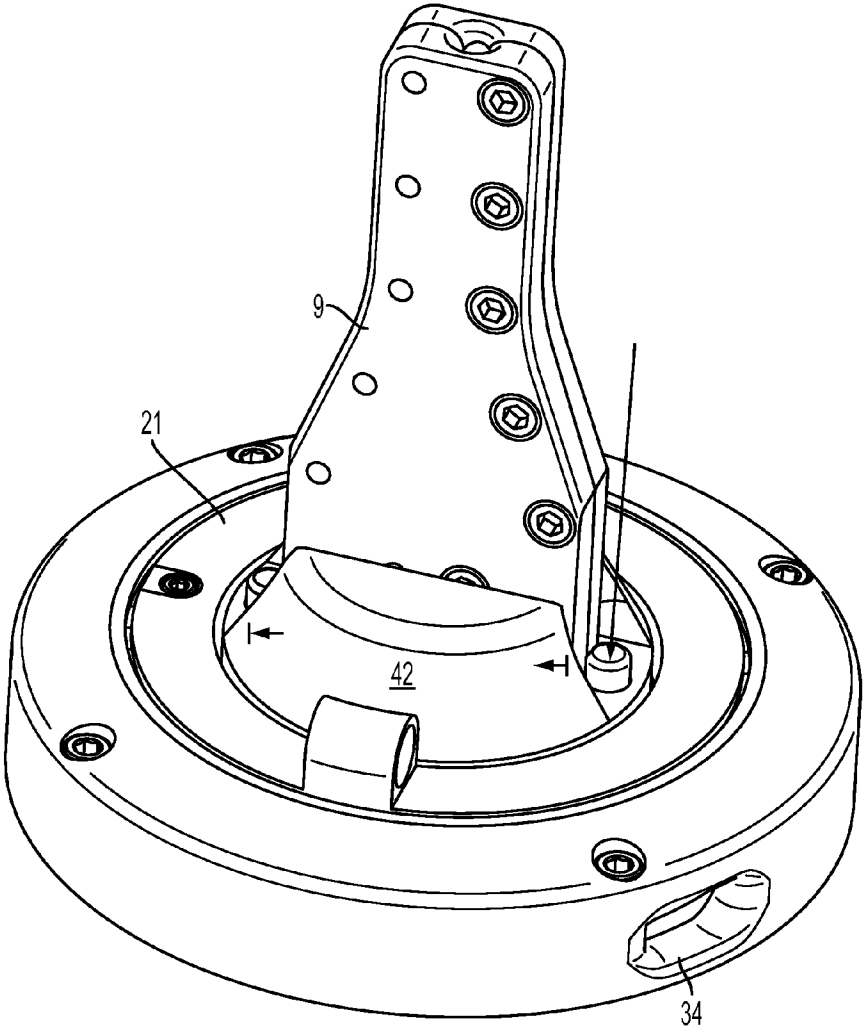
FIG. 4 is a side perspective view of the top of the cable terminal and the lower rotary unit of the top down furling system of FIG. 2, illustrating how a button can be depressed to allow the cable terminal to be removed from the lower rotary unit.
Figure 7:
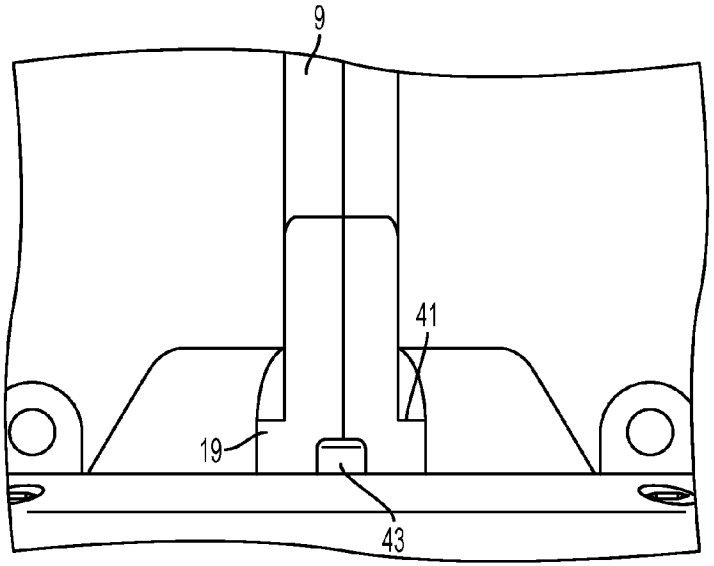
FIG. 7 is an enlarged front view of the attachment of the cable terminal to the lower rotary unit in FIG. 6.
Figure 6:
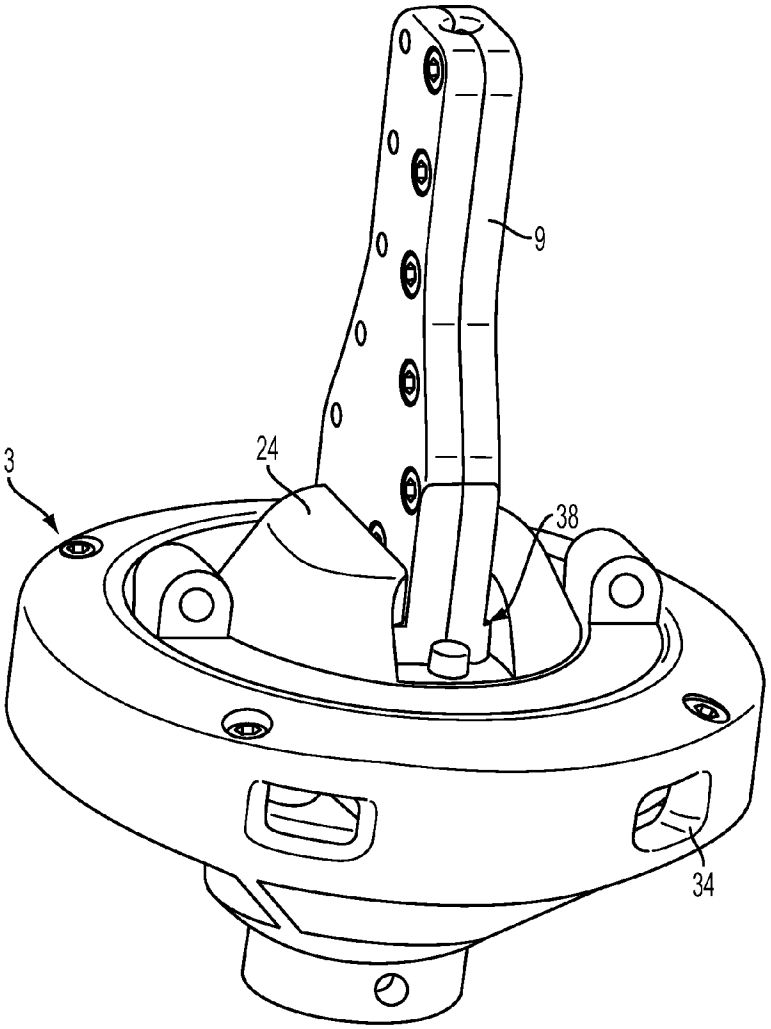
FIG. 6 is a front perspective view of the top of the cable terminal and the lower rotary unit shown in FIG. 4.

FIGS. 6 and 7 show an entrance in the receptacle for the end terminal on both sides. The receptacle could have an entrance for loading and unloading the end terminal on one side only. There is at least one button on the receptacle deck that is spring loaded so that it can recess towards the receptacle deck 44 allowing the end terminal to slide out or into the receptacle. There may be a spring loaded button on each entrance to the receptacle or on only one side with a permanent block on the other side. Once the sail is furled and lowered onto the deck a quick disconnect allows sailors to easily change sails removing one sail furled on its anti-torsion cable 5 and installing a sail of different size, shape or weight. To remove the end terminal 9, the spring loaded button 43 is pressed towards the receptacle deck 44 as shown in the large white arrow. At the same time by moving the end terminal 9 over the button as shown in FIG. 5 by the black arrow, the end terminal 9 can continue to slide out of receptacle 38. To help with this sliding process the button portion of the spring loaded button material might be Delrin or other plastic. Loading the end terminal 9 into the receptacle is similar. The end terminal 9 is used to recess the spring loaded button 43 at which point the end terminal 9 can slide into the receptacle 38. Once the end terminal is inserted completely into the receptacle 38 the spring loaded button 43 pops up locking the end terminal 9 in place. Once in position, tension load on the anti-torsion cable 5 can be applied and met by the lips 19 fitting into the undercuts 41 in the receptacle 38. Torque load can be applied through the furling line 23 around the drive sheave 4 which rotates the driven hub 48 of the lower rotary drive unit 3 rotating the end terminal 9 and the anti-torsion cable 5. Once the sail is furled and lowered onto the deck a quick disconnect allows sailors to easily change sails removing one sail furled on its anti torsion rope and installing a sail of different size, shape or weight.

The end terminal quick attachment and release system is described as part of the lower rotary drive unit. A similar quick attachment and release system could be used at the halyard swivel unit 29.

Thus, the procedure in basic terms is as follows. Bayonet end terminal 46 is slid into socket 15 passing into open cavity 17. Bayonet end terminal 46 is rotated 90 degrees. Bayonet end terminal 46 is retracted and seated into receiving slot 18.

Figure 9:
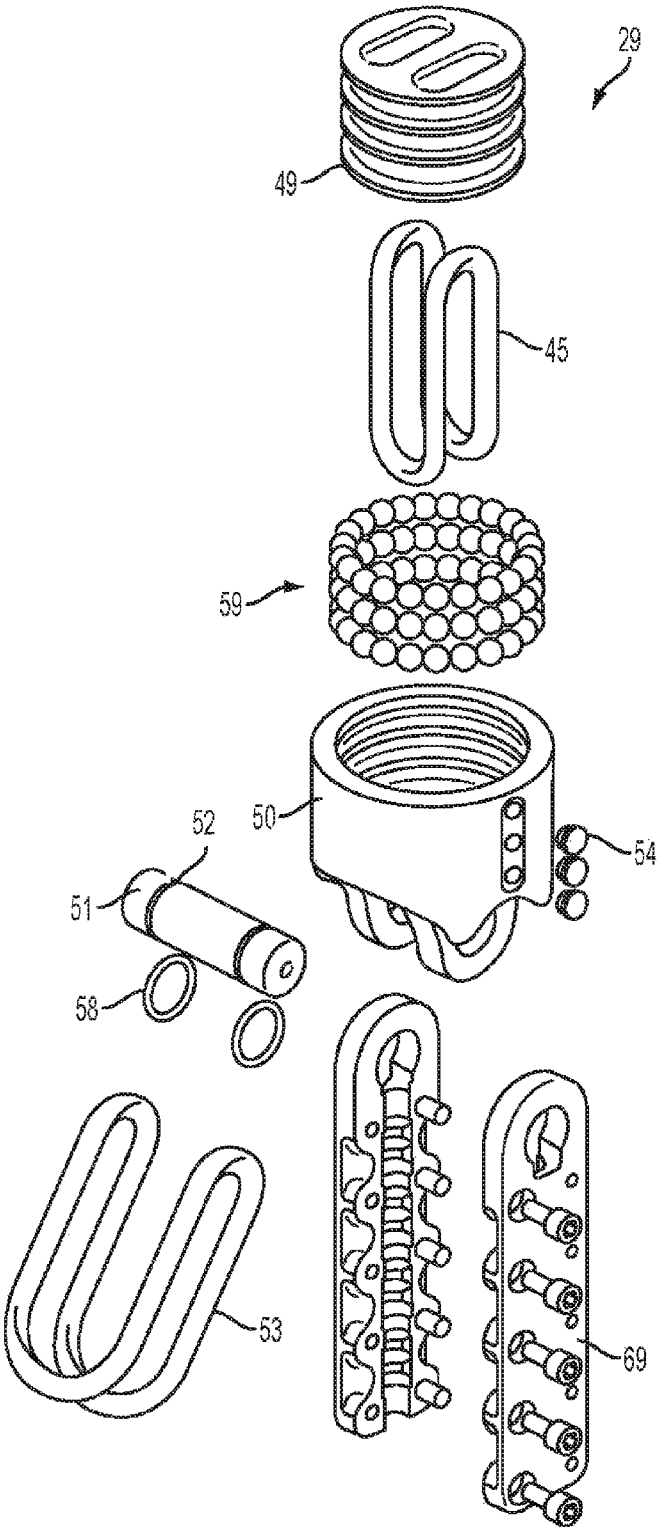
FIG. 9 is a side exploded perspective view of a halyard swivel of the top down furling system of FIG. 2.

FIG. 9 shows the halyard swivel 29 using a bearing system to provide a rotatable link between the masthead 26 and the anti-torsion cable 5 and end terminal 9 or bayonet end terminal 46. The halyard loop 45 is loaded into the halyard swivel 29 through twin slots 48 for connecting to the boat's halyard. FIG. 9 shows the inner race 49 aside the main body 50 in order to show how the halyard loop 45 is loaded. The halyard loop 45 is normally loaded while the halyard swivel 29 is already assembled by loading the halyard loop 45 from below once the end terminal 9 is removed. As shown in FIG. 9, the head loop 53 is loaded onto halyard swivel for attaching the head of the sail 20. Thus the head of the sail and the end terminal 9 can rotate together while the halyard connected to the halyard loop 45 does not rotate. The head loop 53 can pass through the fitting at the top of the sail which may be a metal ring or a webbing type strap or strop. As shown in FIG. 9, once passing through the sail, the loop is pushed into each of the grooves 52 in the cross pin 51.

It is helpful to consider all components of the lower rotary drive unit 3 and the halyard swivel 29 in exploded views. FIGS. 8 and 8A shows the components of the lower rotary drive unit 3:

40 ball loader plug
21 rotary tack swivel
57 rotary tack swivel balls
56 top of fixed portion
9 end terminal
24 driven hub
43 spring loaded buttons
4 drive sheave
54 stripper
39 main bearing system
54 ball plugs
35 fixed portion
30 hook attachment (FIG. 8)
30A bow loop attachment (FIG. 8A)

FIG. 9 shows the components of the halyard swivel 29:

49 inner race
45 halyard loop
59 halyard swivel bearings
54 ball plugs
50 main body
51 crosspin
58 retaining rings
53 head loop
69 end terminal Although the invention has been herein described in what is perceived to be the most practical and preferred embodiments, it is to be understood that the invention is not intended to be limited to the specific embodiment, as set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A release for use in a top-down furling sail system having an anti-torsion cable, a terminal receiving device for connection to the anti-torsion cable, and an end terminal on at least one end of the anti-torsion cable, the release wherein:

the end terminal has outwardly extending lips, and the terminal receiving device has a receptacle for receiving the end terminal, the receptacle having undercuts to receive and releasably hold the end terminal lips so as to provide a tensiley and torsionally secure connection between the anti-torsion cable and the terminal receiving device.

2. A release for use in a top-down furling sail system according to claim 1 wherein the terminal receiving device further includes a spring loaded button adjacent the end terminal receiving receptacle for releasably retaining the end terminal in the terminal receiving receptacle.

* * * * *